US008245604B2

(12) United States Patent
Chen

(10) Patent No.: US 8,245,604 B2
(45) Date of Patent: Aug. 21, 2012

(54) TOOL HEAD POSITIONING STRUCTURE FOR FLEXIBLE WRENCH

(75) Inventor: Tai-Hung Chen, Chang Hua Hsien (TW)

(73) Assignee: Infar Industrial Co., Ltd., Chang Hua Hsien (TW)

( * ) Notice: Subject to any disclaimer, the term of this patent is extended or adjusted under 35 U.S.C. 154(b) by 274 days.

(21) Appl. No.: 12/687,868

(22) Filed: Jan. 14, 2010

(65) Prior Publication Data

US 2011/0167967 A1 Jul. 14, 2011

(51) Int. Cl.
*B25B 23/16* (2006.01)

(52) U.S. Cl. ..... 81/177.8

(58) Field of Classification Search ..... 81/177.7–177.9, 81/60

See application file for complete search history.

(56) References Cited

U.S. PATENT DOCUMENTS 5,199,335 A * 4/1993 Arnold et al. ..... 81/177.8
6,000,302 A * 12/1999 Chiang ..... 81/177.8
7,082,862 B2 * 8/2006 Lee ..... 81/177.8
7,165,480 B2 * 1/2007 Lin ..... 81/177.9
7,168,346 B2 * 1/2007 Lin ..... 81/177.9
7,509,893 B2 * 3/2009 Wu ..... 81/177.8

* cited by examiner

*Primary Examiner* — Monica Carter

*Assistant Examiner* — Melanie Alexander

(74) *Attorney, Agent, or Firm* — Pai Patent & Trademark Law Firm; Chao-Chang David Pai

(57) ABSTRACT

According to the present invention, the main purpose is to provide a tool head positioning structure for a flexible wrench, which includes a handle and a tool head pivotally connected to the handle. The handle includes a controller associated with a retaining member disposed between the controller and the tool head, and the retaining member can be controlled to approach or away from the tool head by rotating the controller. The controller has two continued surfaces, which are pushing portion and retracting portion respectively, and each surface has a depth different from each other. The handle further includes a resilient device engaged to the controller so as to keep in a required position. A user can rotate the controller to make the pushing portion or the retracting portion be aligned with the retaining member so as to fix or adjust an angle of the tool head.

18 Claims, 10 Drawing Sheets

TOOL HEAD POSITIONING STRUCTURE FOR FLEXIBLE WRENCH

BACKGROUND OF THE INVENTION

1. Field of the Invention

The present invention relates to a tool head positioning structure for a flexible wrench and, more particularly, to a flexible wrench whose tool head can be fixed in a required angle.

2. Description of the Related Art

A traditional flexible wrench is formed with a handle pivotally connected to a tool head without any tool head positioning structure such that the tool head can not be positioned precisely while operating the wrench. The traditional flexible wrench has a drawback of improper swing so that some people reform the flexible wrench to add a toothed-structure on a outer periphery of a pivotal section of the tool head, and an engaging structure on the handle corresponding to the toothed-structure. The engaging structure comprises a detent ball and a resilient member abutted against the detent ball. However, the toothed-structure of the tool head may be skip even the engaging structure has engaged therewith.

Referring to FIG. 10, a flexible wrench comprises a handle 70, and a tool head 90 pivotally connected to the handle 70 by a rod 80; a control bar 71 is slidably inserted through the handle 70 adjacent to the rod 80 and along a longitudinal direction of the rod 80. The control bar 71 includes a slot defining an incline surface 710, and a retaining member 72 abutted by the incline surface 710. The retaining member 72 includes a retaining portion on the distal side, in which, the retaining portion can be engaged to a corresponding toothed-structure of the tool head to fix the tool head in an angle; the control bar 71 further includes a recess 711 on the opposite side; the handle 70 further includes a pressing member 74 and a resilient member 73 disposed between the handle 70 and the pressing member 74; the pressing member 74 is pressed by the resilient member 73 to engage to the recess 711 so that the control bar 71 can be elastically positioned in a required position; in the meanwhile, the inclined surface 710 can abut against the retaining member 72 to engage to the tool head 90. However, the flexible wrench still includes drawbacks listed below:

Firstly, the structure is not stable: the retaining member 72 is disposed on the inclined surface 711 of the control bar 71, and the retaining member 72 will provide an unwanted transverse component of force to the control rod 71 while the retaining member 72 is borne a retracting force. The control rod 71 may be displaced by the unwanted transverse component of force so that the control rod 71 is difficult to keep the retaining member 72 to engage with the tool head.

Secondly, the structure is not convenient: an exposing direction of the control bar 71 is on a lateral side of the wrench, a user has to press the control bar 71 laterally to fix the angle of the tool head, in which, the operation step is different from the traditional methods, and that it is difficult to confirm the control bar 71 is fully compressed.

The present invention is, therefore, intended to obviate or at least alleviate the problems encountered in the prior art.

SUMMARY OF THE INVENTION

According to the present invention, the main purpose is to provide a tool head positioning structure for a flexible wrench; in which, a handle, which includes a controller, is pivotally connected to a tool head; a retaining member, which includes a pushing portion and a retracting portion, is slidably inserted between the controller and the tool head, in which, a depth of the pushing portion is different from that of the retracting portion; while the retaining member is respectively aligned with the pushing portion or the retracting portion, the retaining member can be engaged or released to the tool head so as to fix or adjust an angle of the tool head; a fillet portion, which is formed between the pushing portion and retracting portion, can provide a user to operate the flexible wrench smoothly.

A second purpose is to provide a tool head positioning structure for a flexible wrench; in which, the handle 10 further has a resilient device adjacent to the controller, and the controller further has a positioning structure corresponding to the resilient device; the controller can be elastically positioned due to the engagement of the resilient device and the positioning structure so that the fixing and the rotating of the tool head can be more precisely.

A third purpose is to provide a tool head positioning structure for a flexible wrench; in which, the controller includes a bar formed thereon for a user to operate the wrench easily.

Other advantages and features of the present invention will become apparent from the following description referring to the drawings.

BRIEF DESCRIPTION OF THE DRAWINGS

The present invention will be described through detailed illustration of the preferred embodiments referring to the drawings.

DETAILED DESCRIPTION OF THE PREFERRED EMBODIMENT

Figure 1:
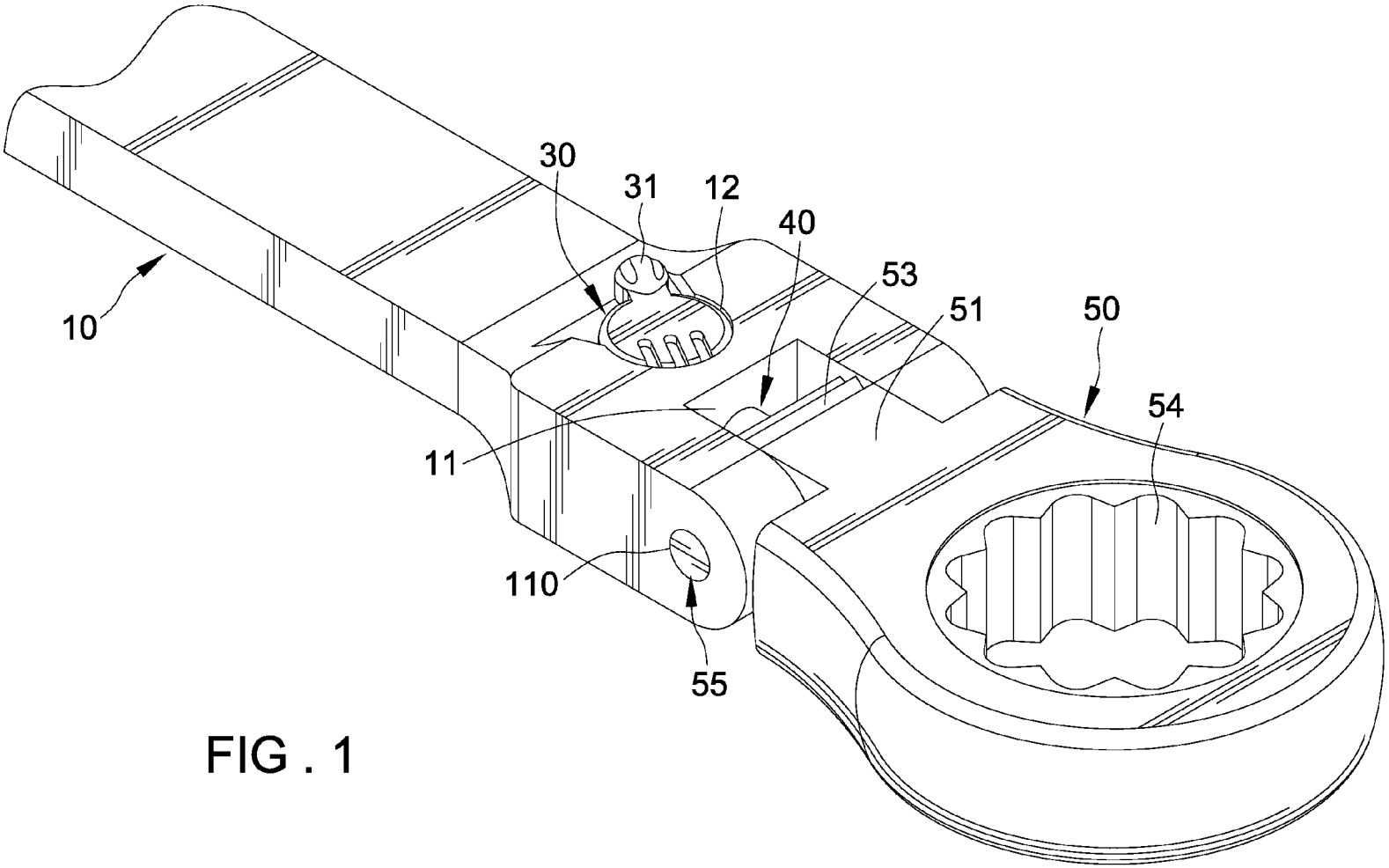
FIG. 1 is a perspective view of a flexible wrench according to the present invention.
Figure 2:
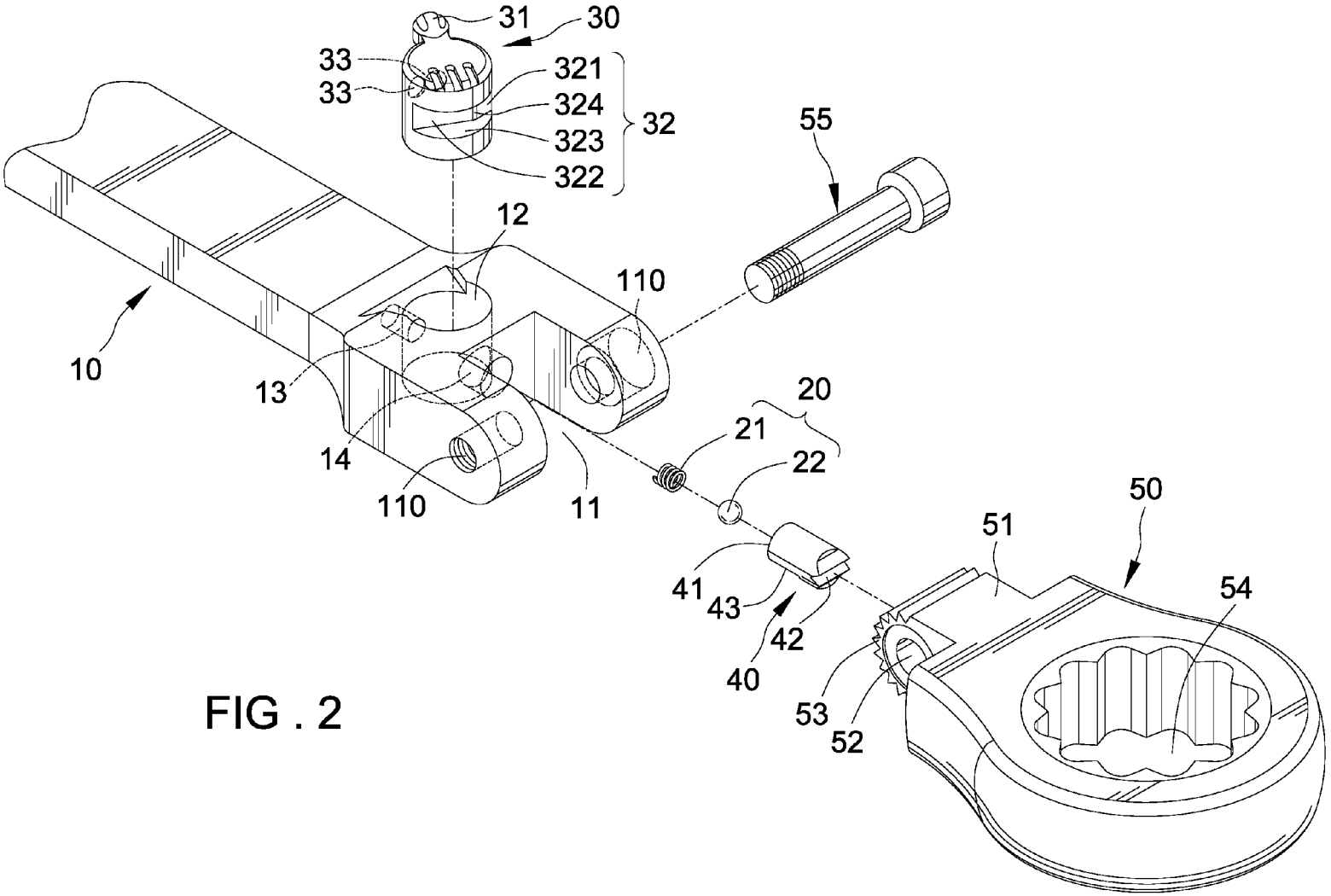
FIG. 2 is an exploded view of the flexible wrench according to the present invention.
Figure 3:
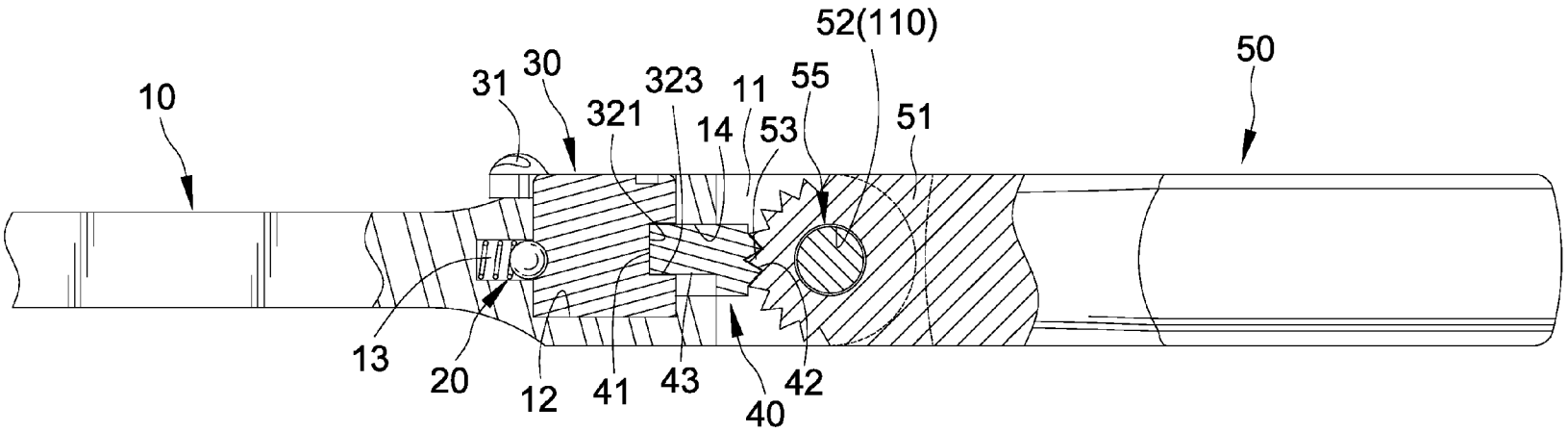
FIG. 3 is a side view of the flexible wrench and shows the tool head in a fixed position.

Referring to FIG. 1 through 3, a flexible wrench comprises a handle 10 defining a proximal end, and a tool head 50 defining a pivotal portion 51. The proximal end of the handle 10 and the pivotal portion 51 of the head 50 are connected with each other and define a pivotal axis. The pivotal portion 51 includes a channel 52 extending therethrough along the pivotal axis, and a retaining portion 53 formed thereon. The retaining portion 53 substantially surrounds a pivotal axis. Preferably, the retaining portion 53 has plurality of teeth. The tool head further includes a driving member 54 to be associated with a screw, nut or tool head.

The proximal end of the handle 10 forms a receptacle 11 corresponding to the pivotal portion 51 of the tool head 50. The receptacle 11 defines two lateral walls and a bottom disposed between the two lateral walls. Two holes 110 extend through the lateral walls respectively, and the holes 110 corresponds to the channel 52 of the pivotal portion 51 so that a rod 55 can be insert through the holes 110 and the channel 52 to make the tool head 50 swing related to the handle 10.

The handle 10 defines a chamber 12 adjacent to the bottom wall of the receptacle 11 and perpendicular to the receptacle 11. A recess 13 is formed on the inner periphery of the chamber 12 so as to receive a resilient device 20. A controller 30, which is pivotally installed to the chamber 12 with plurality of positions, is engaged by the resilient device 20. The proximal end of the handle 10 further includes an aperture 14 extending from the inner periphery of the chamber 12 to the bottom wall of the receptacle 11 so as to be inserted by a retaining member 40 which has a proximal end and a distal end abutted against the controller 30. The distal end of the retaining member 40 will be pressed and an exposing distance of the proximal end of the retaining member 40, which exposes to the aperture 14, will be changed while the controller 30 is pivoted to different position. The tool head 50 can be restricted and fixed in an angle by utilizing the exposing distance of the proximal end of the retaining member 40.

The resilient device 20, which includes a resilient member 21 and a pressing member 22, is installed to the recess 13. The resilient member 21 has a first end abutted against the recess 13, and a second end abutted against the pressing member 22. The pressing member 22 is partially exposed out of the recess 13. Preferably, the resilient member 21 is a coil spring and the pressing member 22 is a steel ball.

The controller 30, which is substantially a column, has a bottom adjacent to the chamber 12, a cover opposite to the bottom of the controller 30, and a peripheral wall defined between the bottom and the cover of the controller 30. A bar 31 horizontally extends from the cover of the controller 30 so as to flip the controller 30 to rotate. A slot 32, which is formed on the peripheral wall of the controller 30, has a bottom wall including at least one pushing portion 321 and at least one retracting portion 322. A depth between the pushing portion 321 and the peripheral wall of the controller 30 is less than that between the retracting portion 322 and the peripheral wall of the controller 30. Two cavities 33 are formed on the peripheral wall of the controller 30 opposite to the slot 32. The resilient device 20 can selectively engage one of the cavities 33 to keep the controller 30 staying in different position, and the pushing portion 321 and the retracting portion 322 can be respectively aligned with the distal end of the retaining member 40. The exposing distance of the proximal end of the retaining member 40 can be changed upon the different depth of the pushing portion 321 and the retracting portion 322. The slot 32 of the controller 30 further defines a restricting portion 323 adjacent to the bottom or the cover of the controller 30 to keep the retaining member 40 being unable to rotate.

The retaining member 40 is substantially a column or a prism. A pressing edge 41, which is formed on the distal end of the retaining member 40, is abutted against the pushing portion 321 or the retracting portion 322. A retaining portion 42, which is formed on the proximal end of the retaining member 40, can be engaged to the retaining portion 53 of the tool head 50. Preferably, the retaining member 40 has at least one tooth. The retaining member 40 further includes a cut 43 adjacent to the distal end, and the cut 43 corresponds to the restricting portion 323 of the slot 32 so that the restricting portion 323 can prevent the retaining member 40 from rotating.

Figure 4:
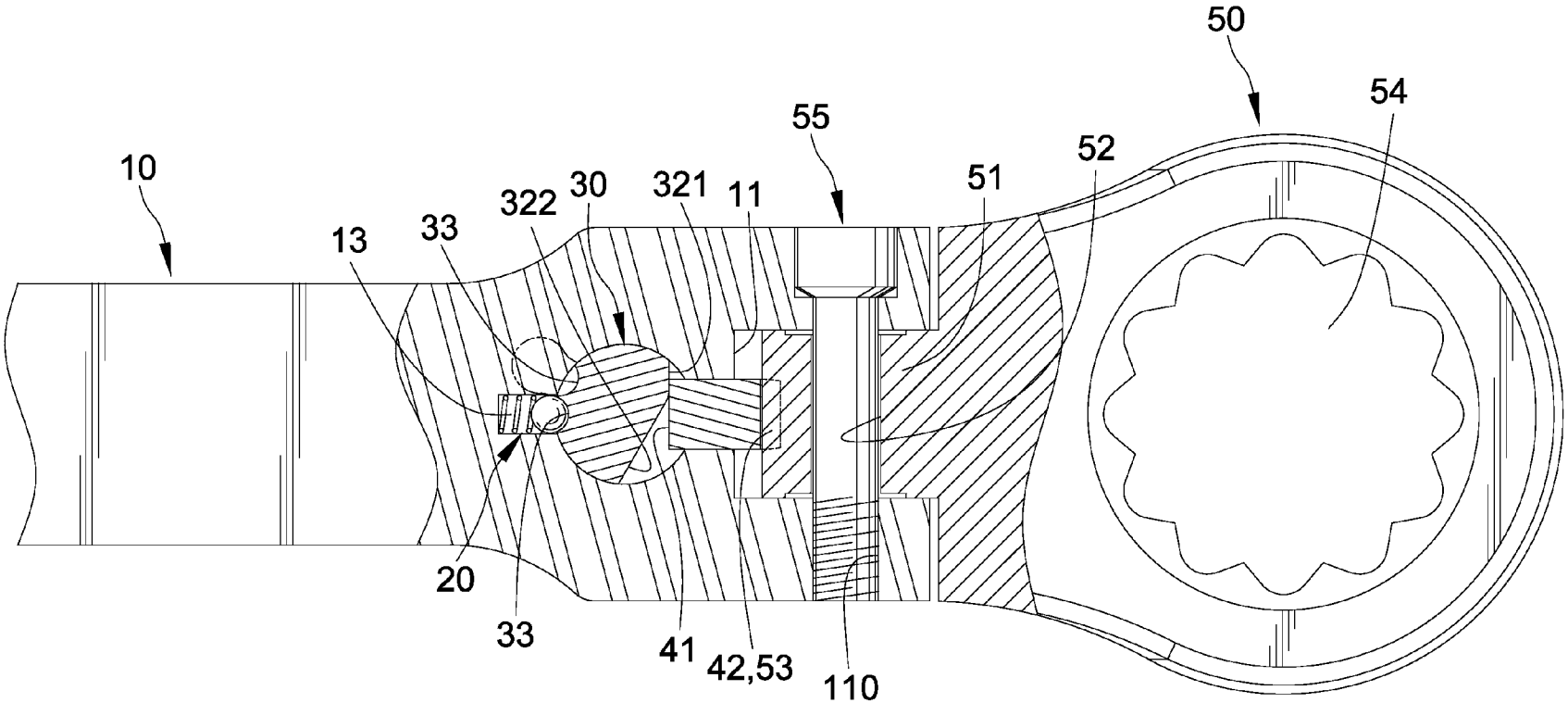
FIG. 4 is a vertical view of the flexible wrench and shows the tool head in the fixed position.

Referring to FIGS. 3 and 4, the controller 30 is rotated to a pushing position. The resilient device 20 is engaged to one of the cavities 33, and the pushing portion 321 is abutted against the pressing edge 41 of the retaining member 40, simultaneously. The depth of the pushing portion 321 is less than that of the retracting portion 322 so that the exposing distance of the proximal end of the retaining member 40 is long enough to abut against the retaining portion 53 of the tool head 50 so as to fix the tool head 50 in a required angle.

Figure 5:
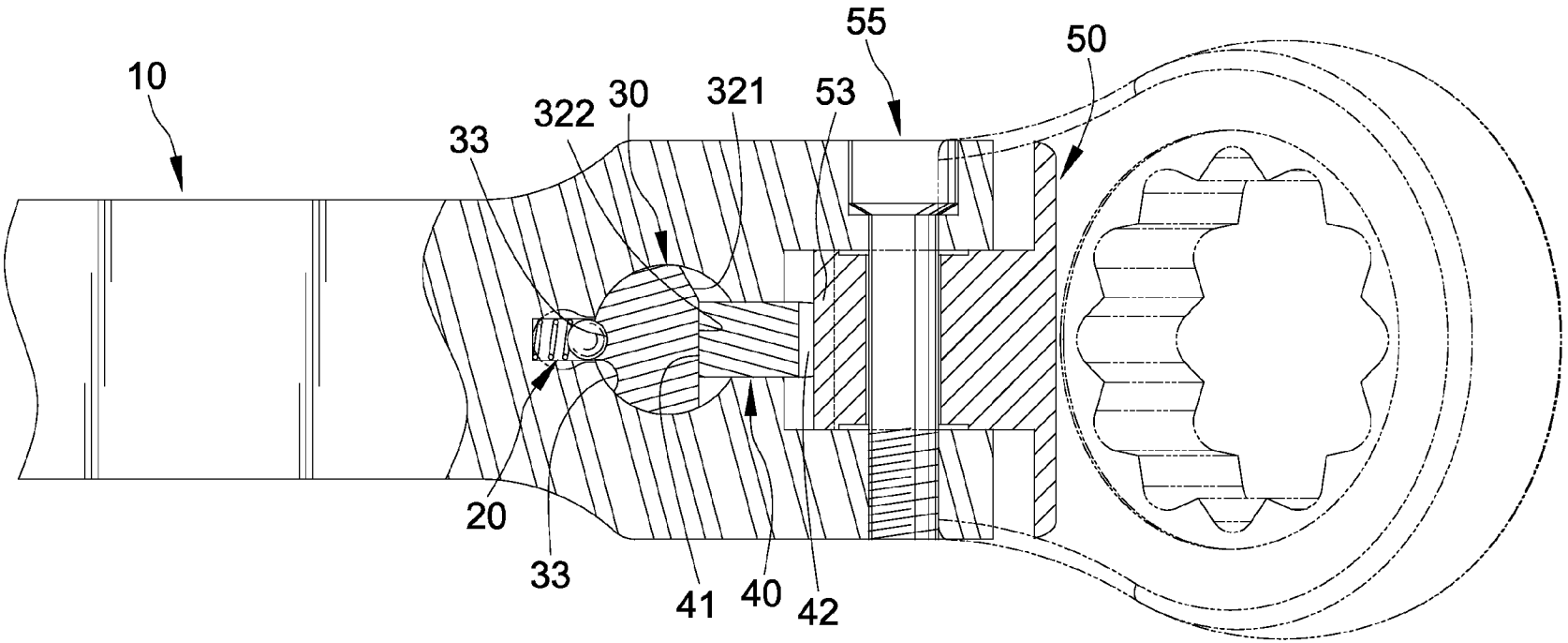
FIG. 5 is a vertical view of the flexible wrench and shows the tool head in the adjustable position.
Figure 6:
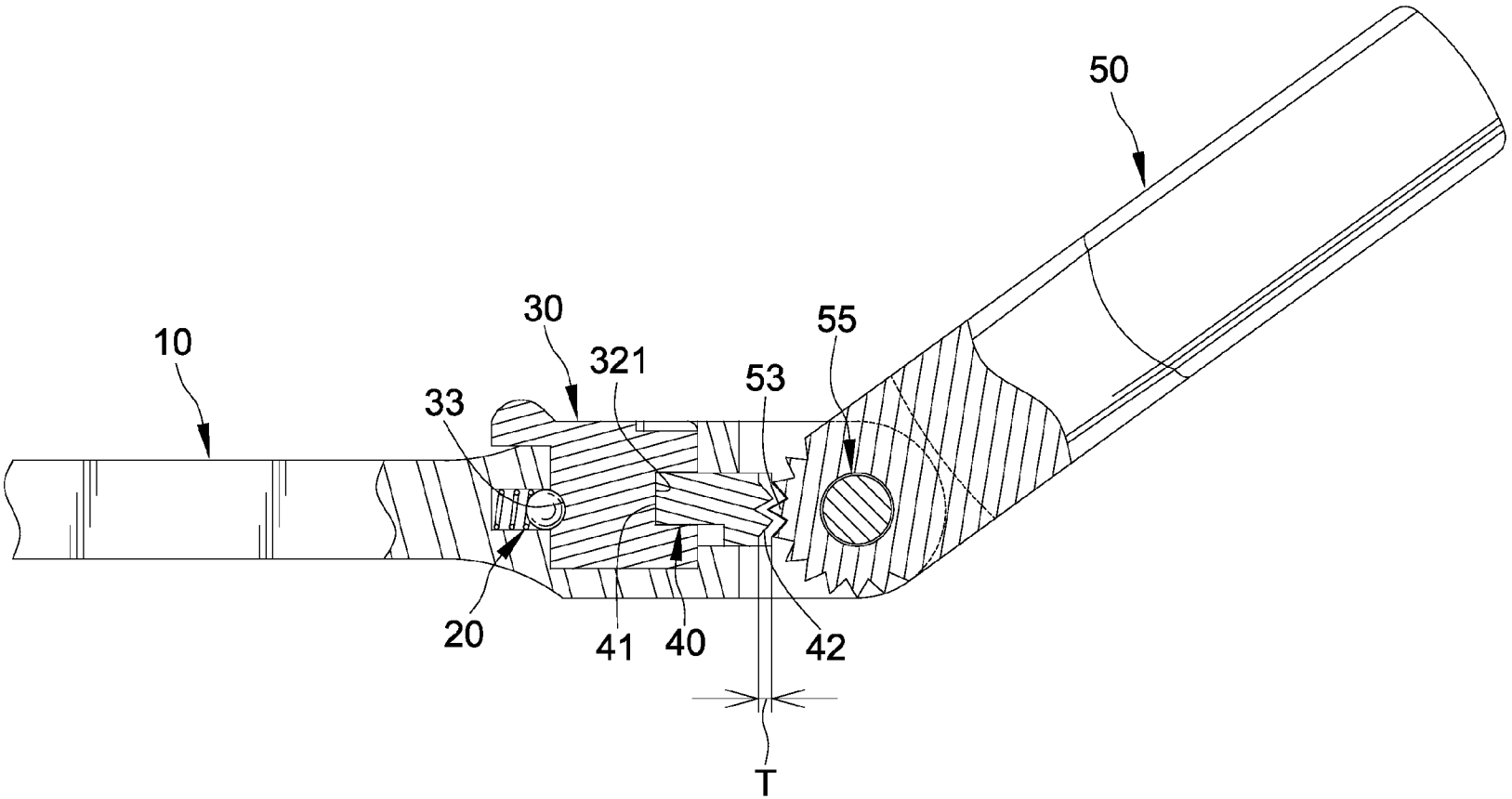
FIG. 6 is a side view of the flexible wrench and shows the tool head in the adjustable position.

Referring to FIGS. 5 and 6, the controller 30 is rotated to a retracting position to change the angle of the tool head 50. In the meanwhile, the resilient device 20 is engaged to another cavity 33, and the retracting portion 322 is aligned with the pressing edge 41 of the retaining member 40, simultaneously. The depth of the retracting portion 322 is long enough for the purpose of allowing the retaining member 40 to retract therein. The retaining member 40 can be retracted by a cooperation of the retaining portion 42 and the retaining portion 53 while the tool head 50 is pivoted related to the rod 55. The tool head 50 can be freely pivoted after retracting the retaining member 40.

Figure 7:
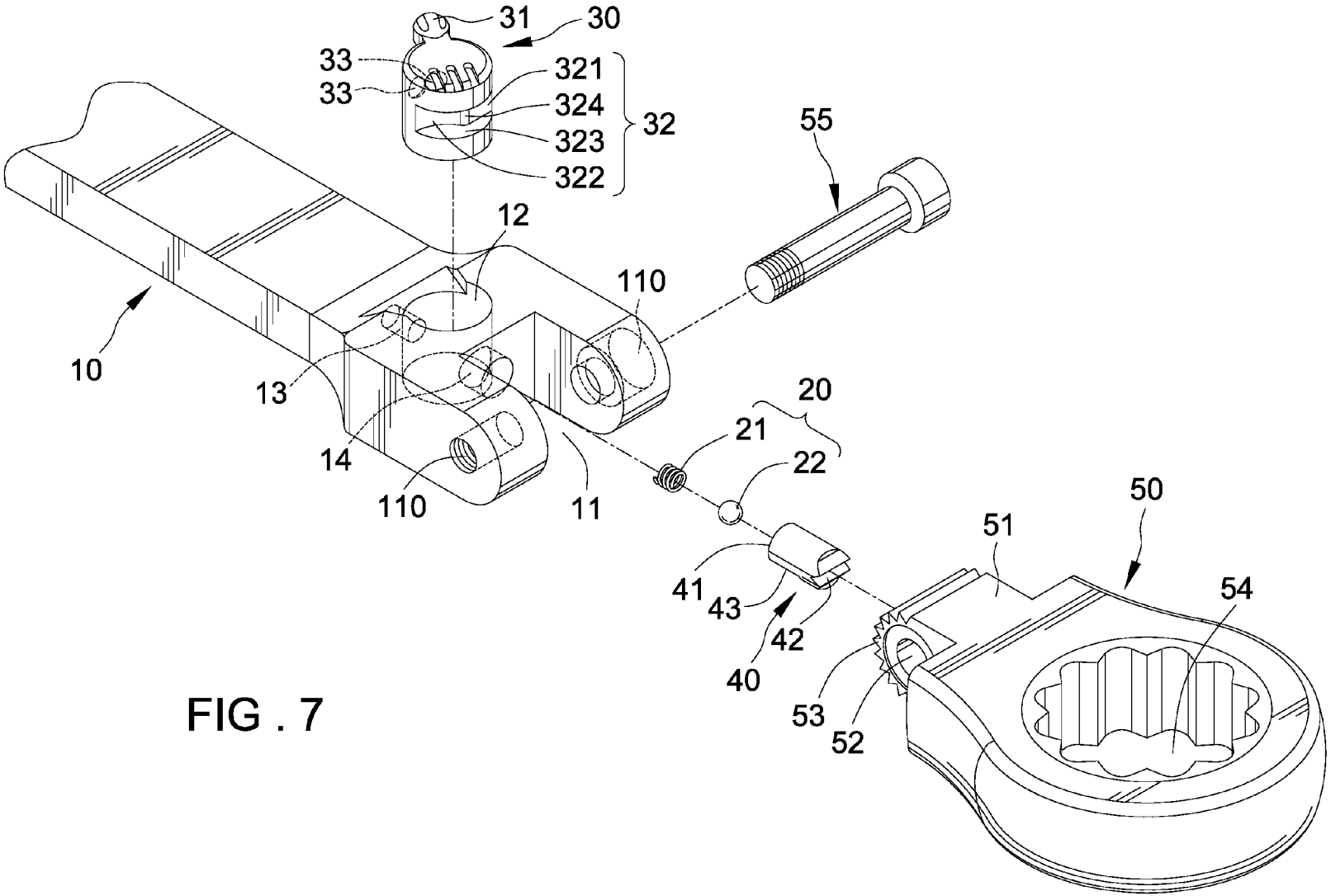
FIG. 7 is an exploded perspective view of the flexible wrench in accordance with a second embodiment of the present invention.

Referring to FIG. 1 through 6, both the pushing portion 321 and the retracting portion 322 are substantially flat structure, and a fillet portion 324 is formed therebetween. Referring to FIG. 7, the pushing portion 321 is substantially a concave and the retracting portion 322 is substantially a convex. The retaining member 40 can be retracted only upon the different depths of the pushing portion 321 and retracting portion 322.

Figure 10:
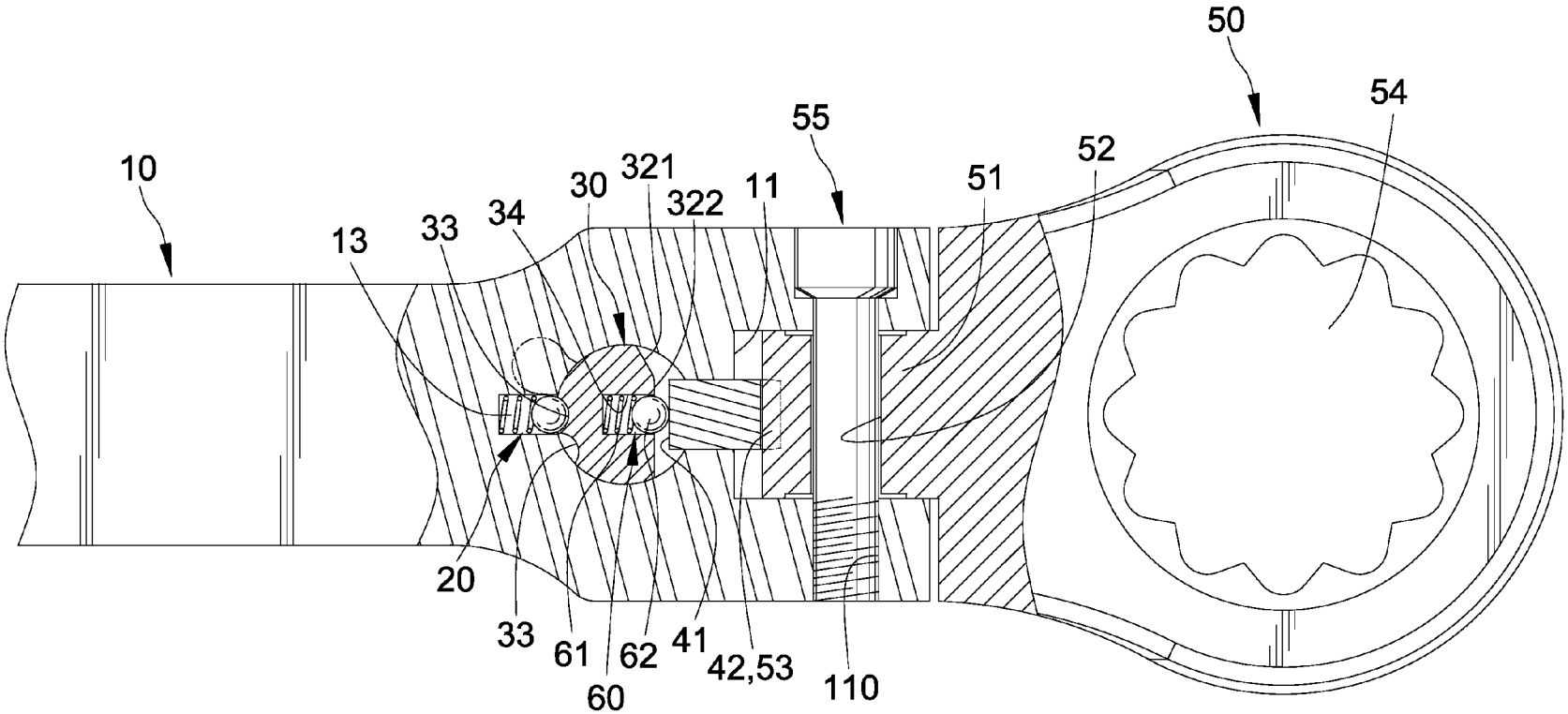
FIG. 10 is a cross section view of the flexible wrench in accordance with a third embodiment of the present invention.
Figure 11:
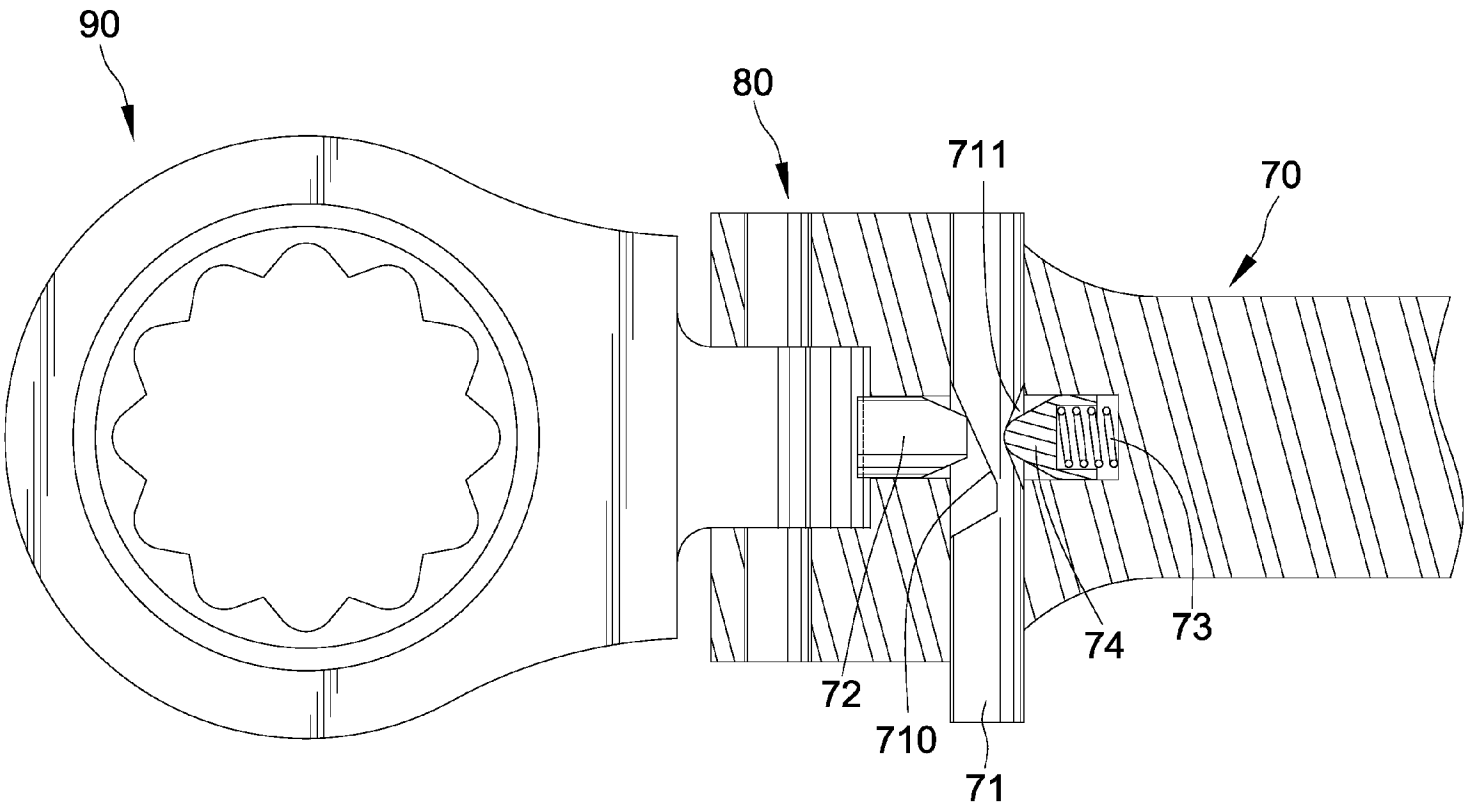
FIG. 11 PRIOR ART
FIG. 11 is a cross section view of the prior art flexible wrench.

Referring to FIG. 10, the controller 30 further includes a recess 34 defined on the retracting portion 322, and the handle 10 further includes an elastic assembly 60 disposed between the retaining member 40 and the controller 30. Preferably, the elastic assembly 60 is installed to the recess 34 of the controller 30. The elastic assembly 60 includes an elastic element 61 disposed in the recess 34, and a steel ball 62. The elastic element 61 defines a proximal end abutted against the recess 34 and a distal end biasing the steel ball 62. The steel ball 62 is biased by the elastic element 61 so that part of the steel ball 62 is exposed out of the recess 34. The retaining member 40 will be pressed by steel ball 62 of the elastic assembly 60 while in the retracting position. Therefore, the tool head 50 can be temporarily engaged while pivoting the tool head 50.

Figure 9:
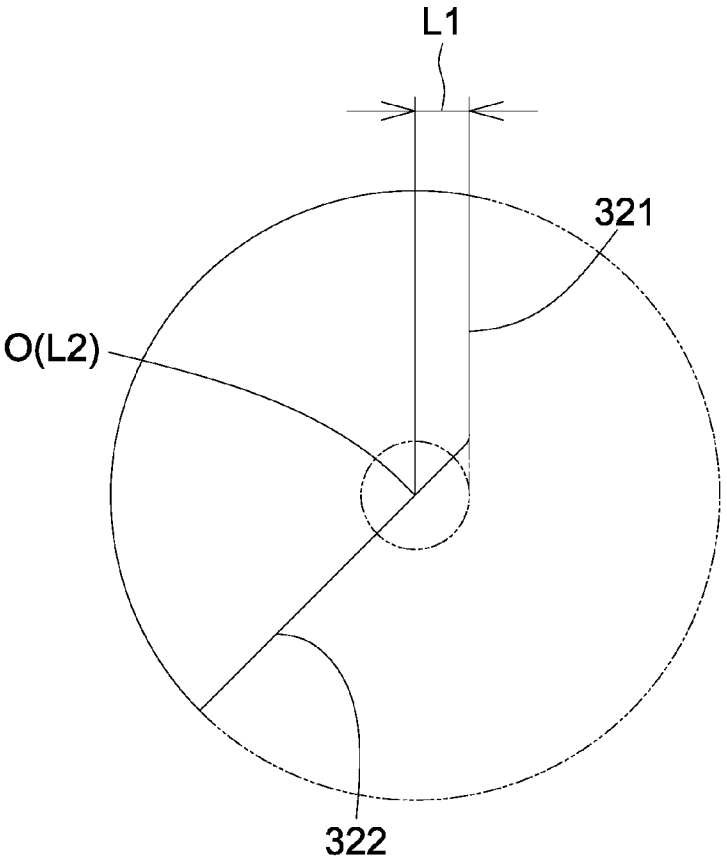
FIG. 9 is a vertical view of the flexible wrench and shows the structure of the pushing portion and the retracting portion, wherein, unlike in FIG. 8, the pushing portion is spaced from the common center and the common center is defined on the retracting portion.
Figure 8:
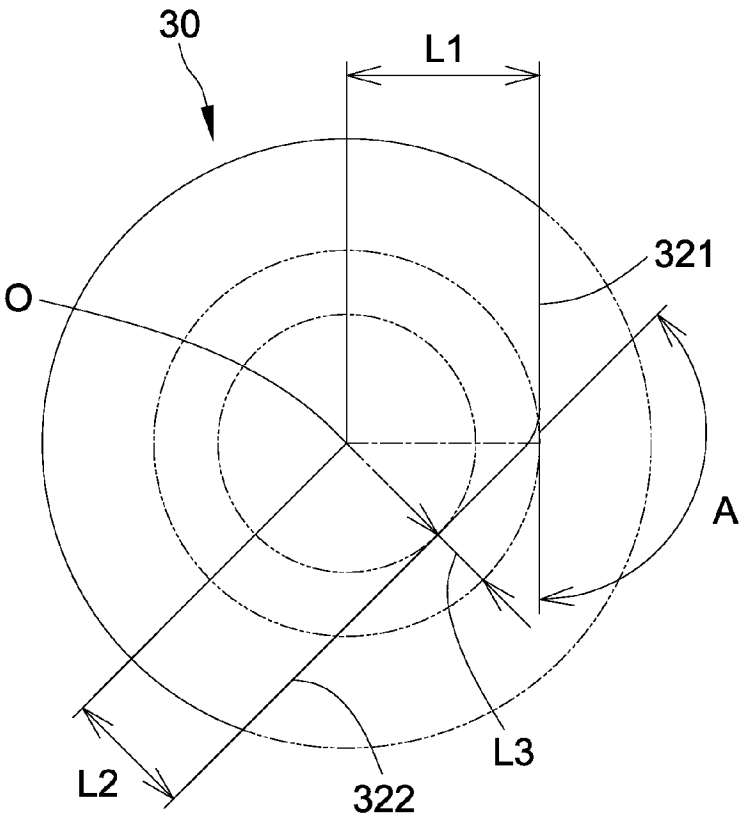
FIG. 8 is a vertical view of the flexible wrench and shows the structure of the pushing portion and the retracting portion, wherein the pushing portion and the retracting portion are spaced from a rotating center which defines a common center, with L1 defining perpendicular distance between the pushing portion and the common center, and L2 defining a perpendicular distance between the retracting portion and the common center.

Referring to FIGS. 8 and 9, an angle A is defined between the pushing portion 321 and retracting portion 322. The pushing portion 321 and the retracting portion 322 further define a common center O while they are rotated. Preferably, the common center O is located at a rotating center of the controller 30. A first distance L1 denotes a perpendicular distance between the common center O and the pushing portion 321, and a second distance L2 denotes a perpendicular distance between the common center O and the retracting portion 322. The first distance L1 is longer than the second distance L2, and a control distance L3 denotes the difference between the first distance L1 and the second distance L2. The angle A is between 100 degrees and 170 degrees. Preferably, the angle A is 135 degrees. The retracting portion 322 can be tangential with the common center O, i.e. the minimal value of the second distance L2 is zero.

Referring to FIG. 6, the retaining member 40 can be retracted while the pressing edge 41 is abutted against the retracting portion 322, in which, a movement distance T is defined between the retaining portion 42 of the retaining member 40 and the retaining portion 53 of the tool head 50 after retracting the retaining member 40. Preferably, the movement distance T is equal to the control distance L3.

Preferably, the fillet portion 324 is substantially a curve so that the controller 30 can be rotated smoothly. Referring to FIGS. 4 and 8, while the pressing edge 41 of the retaining member 40 is abutted against the pushing portion 321 of the controller 30, a downward force, which is generated by the cooperation of the retaining portion 53 of the tool head 50 and the retaining portion 42 of the retaining member 40, can be directly pressed through the common center O and push the handle 10 to abut against the inner periphery of the chamber 12 so that the controller 30 can be firmly positioned during operation.

The structure of the present invention exhibits advantages as follows:

Firstly, the structure is simple and effective; a user can rotate the controller 30 only by a finger to control the retaining member 40 easily.

Secondly, the structure is stable, while the pressing edge 41 is abutted against the pushing portion 321 of the controller 30; the controller 30 is positioned not only by the cavity 33 and the resilient device 20, but also the downward force which directly pushes the handle 10 to abut against the inner periphery of the chamber 12.

Thirdly, the structure is in keeping with the user's habit; the controller 30 includes a bar 31 which can be intuitively controlled by a user.

Fourthly, the structure can be operated into two modes precisely; the controller 30 includes two cavities 33 which can be engaged by the resilient device 20 so that the controller 30 so can be operated into two different positions, precisely.

The present invention has been described through the illustration of the embodiments. Those skilled in the art can derive variations from the embodiments without departing from the scope of the present invention. Hence, the embodiments shall not limit the scope of the present invention defined in the claims.

What is claimed is:

1. A flexible wrench comprising:

a handle defining a proximal end; and a tool head defining a pivotal portion pivotally connected to the proximal end of the handle, wherein the pivotal portion includes a retaining portion formed thereon, with the retaining portion forming a plurality of teeth, and with the tool head further including a driving member formed thereon;

wherein the handle includes a chamber defined thereon, and the chamber has an inner periphery which forms a recess thereon receiving a resilient device, wherein a controller is rotatably installed to the chamber with a plurality of positions and includes a peripheral wall engaged by the resilient device, wherein an aperture extending from the inner periphery of the chamber toward the proximal end of the handle is adjacent to the pivotal portion of the tool head, wherein a retaining member is inserted in the aperture, with the retaining member defining a proximal end and a distal end abutted against the controller, wherein the proximal end of the retaining member is pushed out of the aperture with a different exposing distance for each of the controller's positions so as to engage the tool head while the controller is rotated to different positions;

wherein the controller includes a slot extending in the peripheral wall thereof, and the slot includes a pushing portion and a retracting portion formed thereon, with which the distal end of the retaining member selectively engages, with the controller further having the peripheral wall abutted to the inner periphery of the chamber, wherein the pushing portion and the retracting portion are flat surfaces, wherein the controller has a rotating center that defines a common center of the controller, and a perpendicular distance between the pushing portion and the common center of the controller is different from that between the retracting portion and the common center of the controller, wherein the proximal end of the retaining member is engaged with the tool head while the pushing portion is abutted against the distal end of the retaining member, and the retaining member is retracted and disengaged from the tool head while the retracting portion is aligned with and abutted against the distal end of the retaining member.

2. The flexible wrench as claimed in claim 1, wherein the resilient device including a resilient member and a pressing member is installed to the recess, wherein the pressing member is abutted against the resilient member and partially exposed out of the recess, wherein the resilient member is a coil spring and the pressing member is a steel ball.

3. The flexible wrench as claimed in claim 1, wherein the controller is substantially a column, and the chamber receives the controller, with the controller including a bottom, and a cover opposite to the bottom, with the cover of the controller having a bar extending therefrom, wherein the peripheral wall of the controller further includes two cavities opposite to the slot for selectively receiving the resilient device, wherein the resilient device can selectively engage with one of the cavities to keep the controller staying in a different position, and the pushing portion and the retracting portion can be respectively aligned with the distal end of the retaining member, wherein the slot further defines a restricting portion adjacent to the bottom or the cover to prevent the retaining member from rotating.

4. The flexible wrench as claimed in claim 3, wherein the retaining member is substantially a column or a prism, wherein a pressing edge formed on the distal end of the retaining member is abutted against the pushing portion or the retracting portion, wherein a retaining portion formed on the proximal end of the retaining member can be engaged with the retaining portion of the tool head, with the retaining member having at least one tooth, wherein the retaining member further includes a cut adjacent to the distal end, with the cut corresponding to the restricting portion of the slot so that the restricting portion can prevent the retaining member from rotating.

5. The flexible wrench as claimed in claim 1, wherein a fillet portion is formed between the pushing portion and the retaining portion.

6. The flexible wrench as claimed in claim 1, wherein the slot further includes a fillet portion formed between the pushing portion and the retracting portion, wherein the handle further includes an elastic member disposed between the retaining member and the controller.

7. The flexible wrench as claimed in claim 1 wherein an angle is defined between the pushing portion and the retracting portion, wherein a first distance is defined as the perpendicular distance between the common center and the pushing portion, and a second distance is defined as the perpendicular distance between the common center and the retracting portion, wherein the first distance is longer than the second distance and the second distance is equal to zero, wherein a control distance is defined as the difference between the first distance and the second distance, wherein the angle is between 100 degrees and 170 degrees.

8. A flexible wrench comprising:

a handle defining a proximal end; and a tool head defining a pivotal portion pivotally connected to the proximal end of the handle, wherein the pivotal portion includes a retaining portion formed thereon, with the retaining portion forming a plurality of teeth, and with the tool head further including a driving member formed thereon;

wherein the handle includes a chamber defined thereon, wherein the chamber is shaped substantially like a column, and the chamber has an inner periphery which forms a recess thereon receiving a resilient device, wherein an aperture extending from the inner periphery of the chamber toward the proximal end of the handle is adjacent to the pivotal portion of the tool head;

wherein the resilient device including a resilient member and a pressing member is installed to the recess of the handle, and the resilient member is abutted against the recess and the pressing member, simultaneously, wherein a controller is rotatably installed to the chamber, with the controller including a peripheral wall abutted to the inner periphery of the chamber, wherein the peripheral wall of the controller includes two cavities selectively receiving the resilient device, wherein the pressing member can selectively engage with one of the cavities, wherein the peripheral wall of the controller further includes a slot opposite to the cavities, and the slot includes a pushing portion and a retracting portion formed thereon, wherein the pushing portion and the retracting portion are flat surfaces, wherein the controller has a rotating center that defines a common center of the controller, and a perpendicular distance between the pushing portion and the common center of the controller is different from that between the retracting portion and the common center of the controller;

wherein a retaining member is inserted in the aperture, with the retaining member defining a proximal end engaged with the pivotal portion of the tool head and a distal end inserted through the aperture;

wherein the proximal end of the retaining member is engaged with the tool head while the pushing portion is abutted against the distal end of the retaining member, and the retaining member is retracted and disengaged from the tool head while the retracting portion is aligned with and abutted against the distal end of the retaining member.

9. The flexible wrench as claimed in claim 8, wherein the handle further includes an elastic assembly disposed between the retaining member and the controller, wherein the resilient assembly includes a coil spring and a steel ball.

10. The flexible wrench as claimed in claim 8 wherein the controller is substantially a column, with the controller including a bottom, and a cover opposite to the bottom, with the cover of the controller having a bar extending therefrom, wherein the resilient device can selectively engage with one of the cavities to keep the controller staying in a different position, and the pushing portion and the retracting portion can be respectively aligned with the distal end of the retaining member, wherein the slot further defines a restricting portion adjacent to the bottom or the cover to prevent the retaining member from rotating.

11. The flexible wrench as claimed in claim 10 wherein the retaining member is substantially a column or a prism, wherein a pressing edge formed on the distal end of the retaining member is abutted against the pushing portion or the retracting portion, wherein a retaining portion formed on the proximal end of the retaining member can be engaged with the retaining portion of the tool head, with the retaining member having at least one tooth, wherein the retaining member further includes a cut adjacent to the distal end, with the cut corresponding to the restricting portion of the slot so that the restricting portion can prevent the retaining member from rotating.

12. The flexible wrench as claimed in claim 8, wherein a fillet portion is formed between the pushing portion and the retracting portion.

13. The flexible wrench as claimed in claim 8 wherein an angle is defined between the pushing portion and the retracting portion, wherein a first distance is defined as the perpendicular distance between the common center and the pushing portion, and a second distance is defined as the perpendicular distance between the common center and the retracting portion, wherein the first distance is longer than the second distance and the second distance is equal to zero, wherein a control distance is defined as the difference between the first distance and the second distance, wherein the angle is between 100 degrees and 170 degrees.

14. A flexible wrench comprising:

a handle defining a proximal end; and a tool head defining a pivotal portion pivotally connected to the proximal end of the handle, wherein the pivotal portion includes a retaining portion formed thereon, with the retaining portion forming a plurality of teeth, and with the tool head further including a driving member formed thereon;

wherein the handle includes a chamber defined thereon, wherein the chamber is shaped substantially like a column, and the chamber has an inner periphery which forms a recess thereon receiving a resilient device, wherein an aperture extending from the inner periphery of the chamber toward the proximal end of the handle is adjacent to the pivotal portion of the tool head;

wherein the resilient device including a resilient member and a pressing member is installed to the recess of the handle, and the resilient member is abutted against the recess and the pressing member, simultaneously, wherein a controller is rotatably installed to the chamber, with the controller including a peripheral wall abutted to the inner periphery of the chamber, wherein the peripheral wall of the controller includes two cavities selectively receiving the resilient device, wherein the pressing member can selectively engage with one of the cavities, wherein the peripheral wall of the controller further includes a slot opposite to the cavities, and the slot includes a pushing portion and a retracting portion formed thereon, wherein the pushing portion and the retracting portion are flat surfaces, wherein the controller has a rotating center that defines a common center of the controller, and a perpendicular distance between the pushing portion and the common center of the controller is different from that between the retracting portion and the common center of the controller, wherein the slot further includes a fillet portion formed between the pushing portion and the retracting portion;

wherein a retaining member is inserted in the aperture, with the retaining member defining a proximal end engaged with the pivotal portion of the tool head and a distal end inserted through the aperture;

wherein the proximal end of the retaining member is engaged with the tool head while the pushing portion is abutted against the distal end of the retaining member, and the retaining member is retracted and disengaged from the tool head while the retracting portion is aligned with and abutted against the distal end of the retaining member.

15. The flexible wrench as claimed in claim 14 wherein the controller is substantially a column, with the controller including a bottom, and a cover opposite to the bottom, with the cover of the controller having a bar extending therefrom, wherein the resilient device can selectively engage with one of the cavities to keep the controller staying in a different position, and the pushing portion and the retracting portion can be respectively aligned with the distal end of the retaining member, wherein the slot further defines a restricting portion adjacent to the bottom or the cover to prevent the retaining member from rotating.

16. The flexible wrench as claimed in claim 15 wherein the retaining member is substantially a column or a prism, wherein a pressing edge formed on the distal end of the retaining member is abutted against the pushing portion or the retracting portion, wherein a retaining portion formed on the proximal end of the retaining member can be engaged with the retaining portion of the tool head, with the retaining member having at least one tooth, wherein the retaining member further includes a cut adjacent to the distal end, with the cut corresponding to the restricting portion of the slot so that the restricting portion can prevent the retaining member from rotating.

17. The flexible wrench as claimed in claim 14, wherein the handle further includes an elastic member disposed between the retaining member and the controller.

18. The flexible wrench as claimed in claim 14 wherein an angle is defined between the pushing portion and the retracting portion, wherein a first distance is defined as the perpendicular distance between the common center and the pushing portion, and a second distance is defined as the perpendicular distance between the common center and the retracting portion, wherein the first distance is longer than the second distance and the second distance is equal to zero, wherein a control distance is defined as the difference between the first distance and the second distance, wherein the angle is between 100 degrees and 170 degrees.

* * * * *